US009228585B2

(12) United States Patent
Kachele

(10) Patent No.: US 9,228,585 B2
(45) Date of Patent: Jan. 5, 2016

(54) ECCENTRIC SCREW MACHINE WITH ASYMMETRICAL PROJECTIONS

(71) Applicant: Wilhelm Kachele GmbH, Jahnstr. (DE)

(72) Inventor: Bruno Kachele, Jahnstr. (DE)

(73) Assignee: Wilhelm Kachele GmbH, Johnstr. (DE)

( * ) Notice: Subject to any disclaimer, the term of this patent is extended or adjusted under 35 U.S.C. 154(b) by 150 days.

(21) Appl. No.: 14/058,566

(22) Filed: Oct. 21, 2013

(65) Prior Publication Data

US 2014/0286808 A1 Sep. 25, 2014

(30) Foreign Application Priority Data

Mar. 22, 2013 (DE) ..... 10 2013 102 979

(51) Int. Cl.
*F04C 2/107* (2006.01)

(52) U.S. Cl.
CPC ..... *F04C 2/1075* (2013.01)

(58) Field of Classification Search
CPC ..... F04C 2/1075
See application file for complete search history.

(56) References Cited

U.S. PATENT DOCUMENTS

| | | | | |
|---|---|---|---|---|
| 6,716,008 | B1 | 4/2004 | Kachele | |
| 7,316,268 | B2 | 1/2008 | Peleanu et al. | |
| 7,837,451 | B2 * | 11/2010 | Wiedenhoefer et al. | 418/48 |
| 7,909,591 | B2 | 3/2011 | Kachele | |
| 8,672,656 | B2 * | 3/2014 | Guidry, Jr. | 418/178 |
| 8,905,733 | B2 * | 12/2014 | Guidry, Jr. | 418/48 |
| 2012/0024632 | A1 * | 2/2012 | John | 184/13.1 |
| 2014/0170011 | A1 * | 6/2014 | Clouzeau et al. | 418/201.1 |

FOREIGN PATENT DOCUMENTS

EP 0764783 B1 3/1997

* cited by examiner

*Primary Examiner* — Mary A Davis
(74) *Attorney, Agent, or Firm* — Emch, Schaffer, Schaub & Porcello Co. L.P.A.

(57) ABSTRACT

An eccentric screw machine (10) demonstrates a Stator (11) having an inner lining (17), which demonstrates teeth projecting inwards. The tips of these teeth are provided with micro-ribs (26 to 29), which are embodied asymmetrically with respect to the radials (R). They preferably demonstrate a flatly rising edge (30) and a steeply falling edge (31). This thus results in improved operating performance, depending on the direction of rotation.

16 Claims, 6 Drawing Sheets

ECCENTRIC SCREW MACHINE WITH ASYMMETRICAL PROJECTIONS

CROSS REFERENCE TO RELATED APPLICATION

Figure 1:
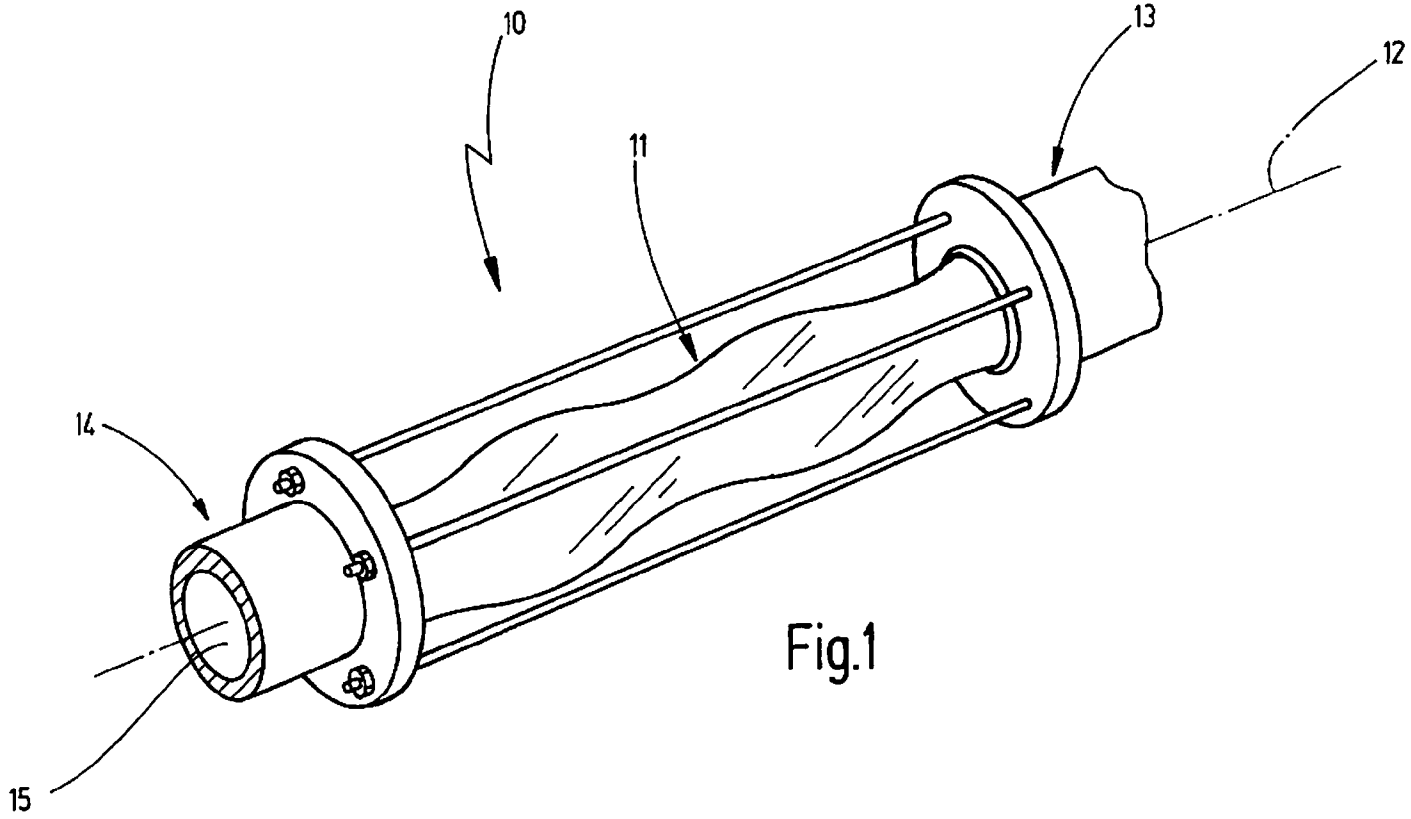

The present patent application is based upon and claims the benefit German patent application no. 10 2013 102 979.5; filed Mar. 22, 2013.

BACKGROUND OF THE INVENTION

The invention relates to an eccentric screw machine, an eccentric screw motor or an eccentric screw pump for example, especially for sludgy media.

Eccentric screw machines are known from DE 102 45 497 B3 for example. They consist of a stator, which demonstrates a screw-shaped channel within which a screw-shaped rotor rotates. The screw-shaped channel defines a cross section which corresponds to a profile of an internal helical cut gearwheel. The cross section of the rotor corresponds to a pinion, which has one tooth less than the rotor. Together, the rotor and stator form chambers. When the rotor rotates, the center point of the cross section ideally moves on a circular path. Each cross section of the rotor thus executes an orbital movement around the longitudinal axis of the channel, the rotor also rotating around itself. Since the exterior surface of the rotor and the channel in the stator are both screw-shaped with the same direction of rotation, approximately banana-shaped hollows arise along the rotor advancing from one end of the stator toward the other end while the rotor is in motion. Other chambers, which are enclosed by other areas of the stator and other areas of the rotor, seal and separate each of these banana-shaped chambers. The stator is provided with an elastomeric lining to ensure a good seal between the separate chambers. To extend the temperature range of such eccentric screw pumps which are known in principle, the citation suggests that additional ribs, which run along the teeth, be mounted on the stator. The rotor elastically deforms these additional ribs, wherein they locally increase the surface pressure between the elastomeric lining and the rotor. The contact pressure between the rotor and stator can thereby be reduced overall. Moreover, the flexibility of the elastomeric lining is increased. In addition, space for accommodating material is created between the separate ribs, thereby improving the ability of the material to avoid the rotor.

Another eccentric screw pump, which is similarly constructed in principle, is known from EP 0 764 783 A1. However in place of continuous ribs on the elastomeric lining, there are provided finely structured projections in the shape of round heads, which are scaly and arranged one behind the other in rows. In this connection, the individual heads of one row are displaced relative to the heads of the adjacent row by approximately half the length of the heads of one row. Indentations, which separate the heads from one another, are located between the heads. This is intended to achieve a nonlinear impression characteristic of the individual projections, wherein the indentations located between the projecting parts are not formed as wide separation channels, but rather in such a manner that the pumped fluid or mash produces a lubricating effect that is not impaired when the fluid or mash is discharged. In particular, thusly designed eccentric screw pumps are supposed to require lower initial break-away torques during startup.

Eccentric screw machines of the above type are supposed to have a frictional resistance that is as low as possible during operation, wherein the chambers are supposed to be sealed relative to one another and wherein the wear of the elastomeric lining and/or the rotor is supposed to be low.

SUMMARY OF THE INVENTION

Proceeding from above, it is the objective of the invention to create an eccentric screw machine that is improved in at list one respect.

This objective is accomplished with the eccentric screw machine according to claim 1:

The eccentric screw machine according to the invention is suitable for sludgy media and can be used both as a pump and particularly also as a motor. It demonstrates a stator which defines a channel delimited by an elastomeric material. The channel has a cross section which demonstrates a maximum radius at at least two locations separated from one another in the circumferential direction and demonstrates inward protuberances between them. The cross section thus corresponds to a hollow gearwheel having at least two teeth. A rotor, which delimits at least one chamber with the stator, is arranged within the stator.

According to the invention additional projections, which are embodied asymmetrically relative to the radial direction, are provided on the inward protuberances of the rotor, i.e. on its teeth. They thus have one long and one short edge in the circumferential direction, for example. The other projections can demonstrate a round profile, a triangular profile, a trapezoidal profile or another asymmetric profile. The other projections are relatively small in relation to the inward protuberances both in the radial direction and in the circumferential direction. Hereinafter, they will therefore be called "micro-projections" or "micro-ribs".

The rotor cross section preferably demonstrates a maximum radius at at least two locations. These locations are preferably formed by helical grooves, which extend along the stator and wind around its centerline. The "inward protuberances" in the shape of screw-shaped ribs or "teeth" are embodied between the helical grooves. The micro-ribs preferably run along these teeth, preferably on their respective tooth tip. The micro-ribs are embodied asymmetrically. They therefore define a preferred rotational direction for the rotor and effect that the rotor rotates with lower frictional resistance and/or lower wear and/or better sealing effect in at least one direction of rotation than in the other direction. This makes it possible to provide eccentric screw motors that feature increased performance and/or increased reliability and/or smaller size. In particular, the asymmetric micro-ribs can promote the development of a hydrodynamic lubrication between the rotor and the lining.

Other objects and advantages of the present invention will become apparent to those skilled in the art upon a review of the following detailed description of the preferred embodiments and the accompanying drawings.

IN THE DRAWINGS

FIG. 1 an eccentric screw machine, in schematic, perspective representation.

Figure 2:
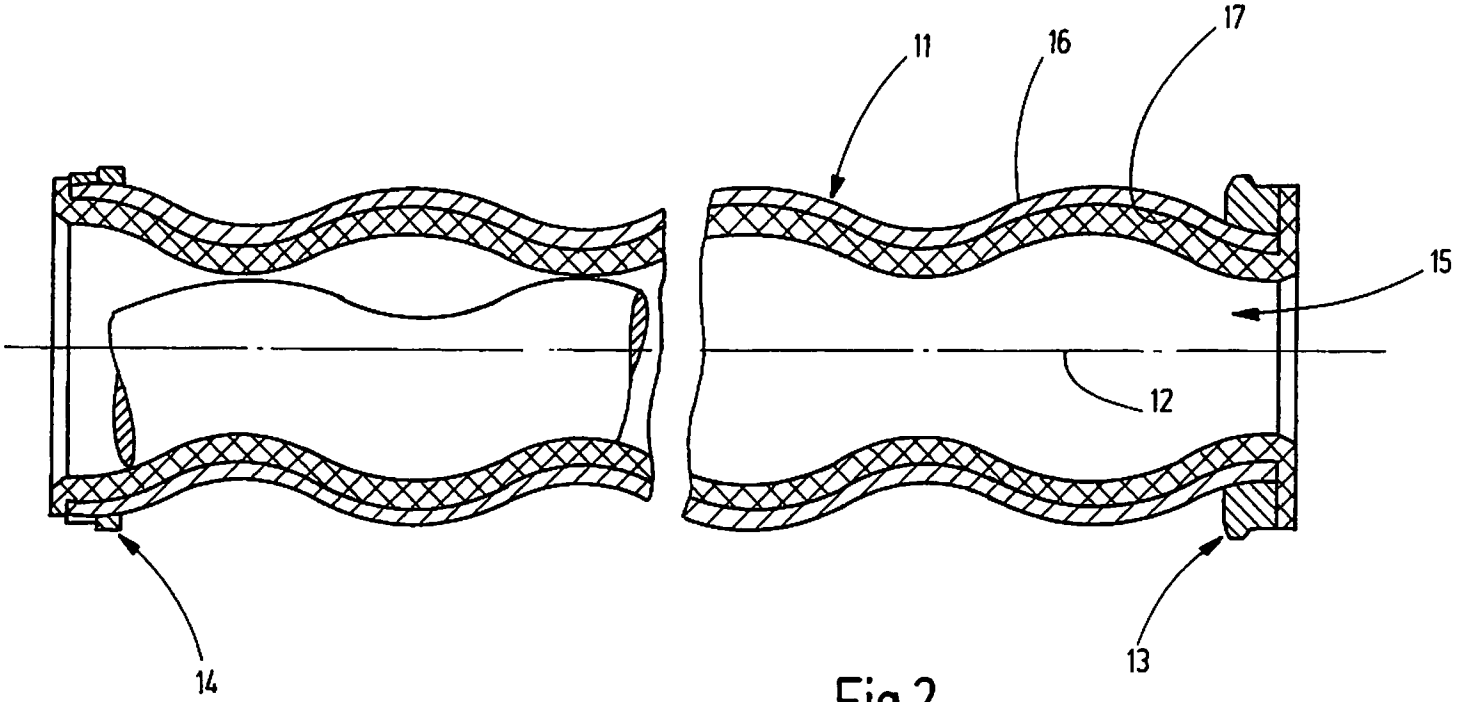

FIG. 2 the eccentric screw machine, represented in cutouts in longitudinal section.

Figure 3:
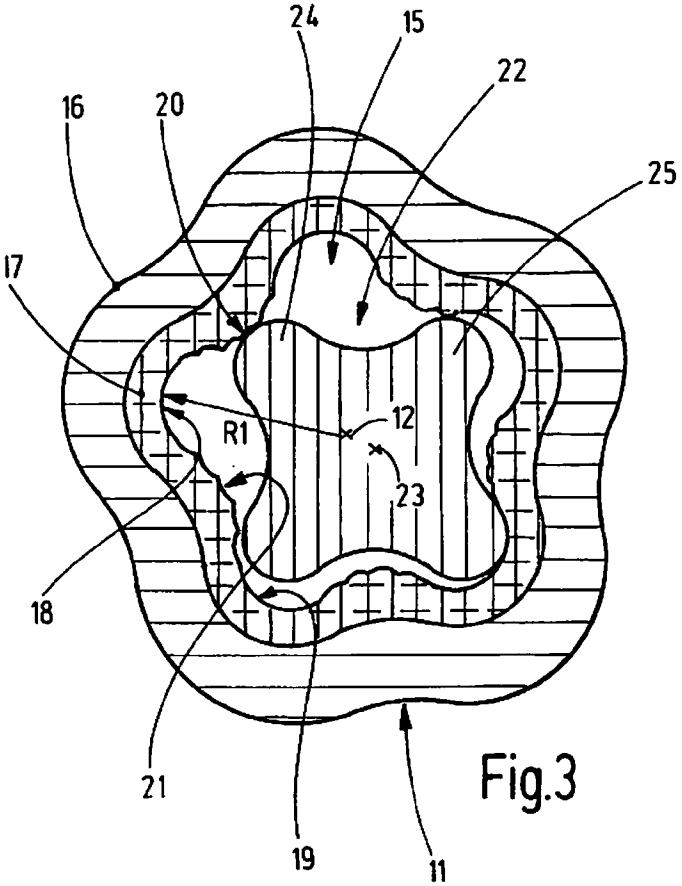

FIG. 3 the eccentric screw machine according to FIGS. 1 and 2, in cross section.

Figure 4:
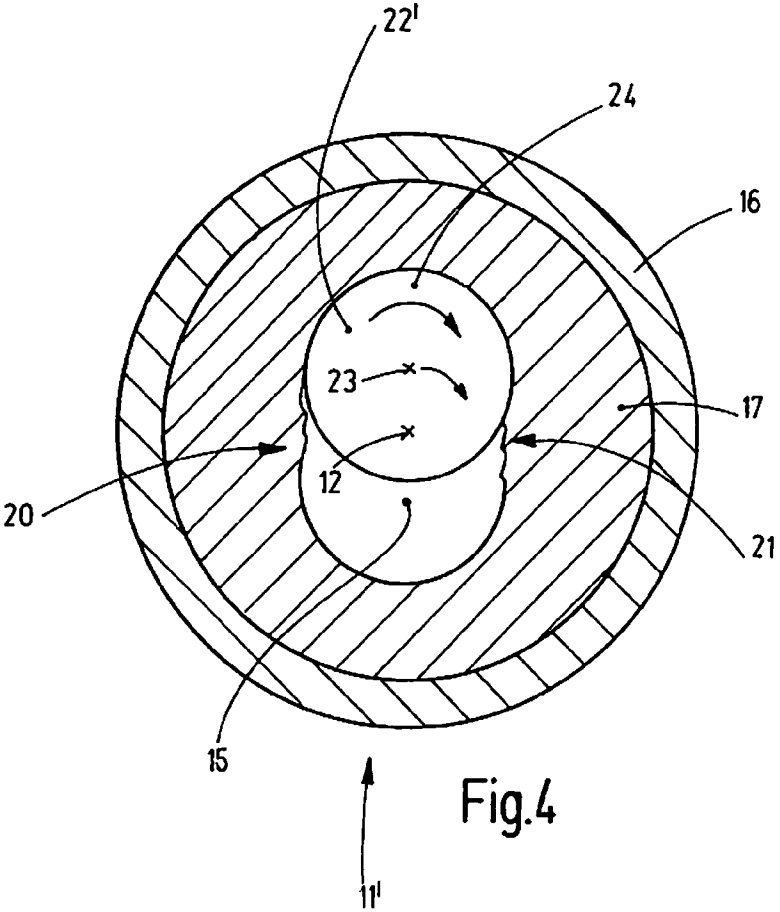

FIG. 4 a modified embodiment of the eccentric screw machine, in cross section.

Figure 5:
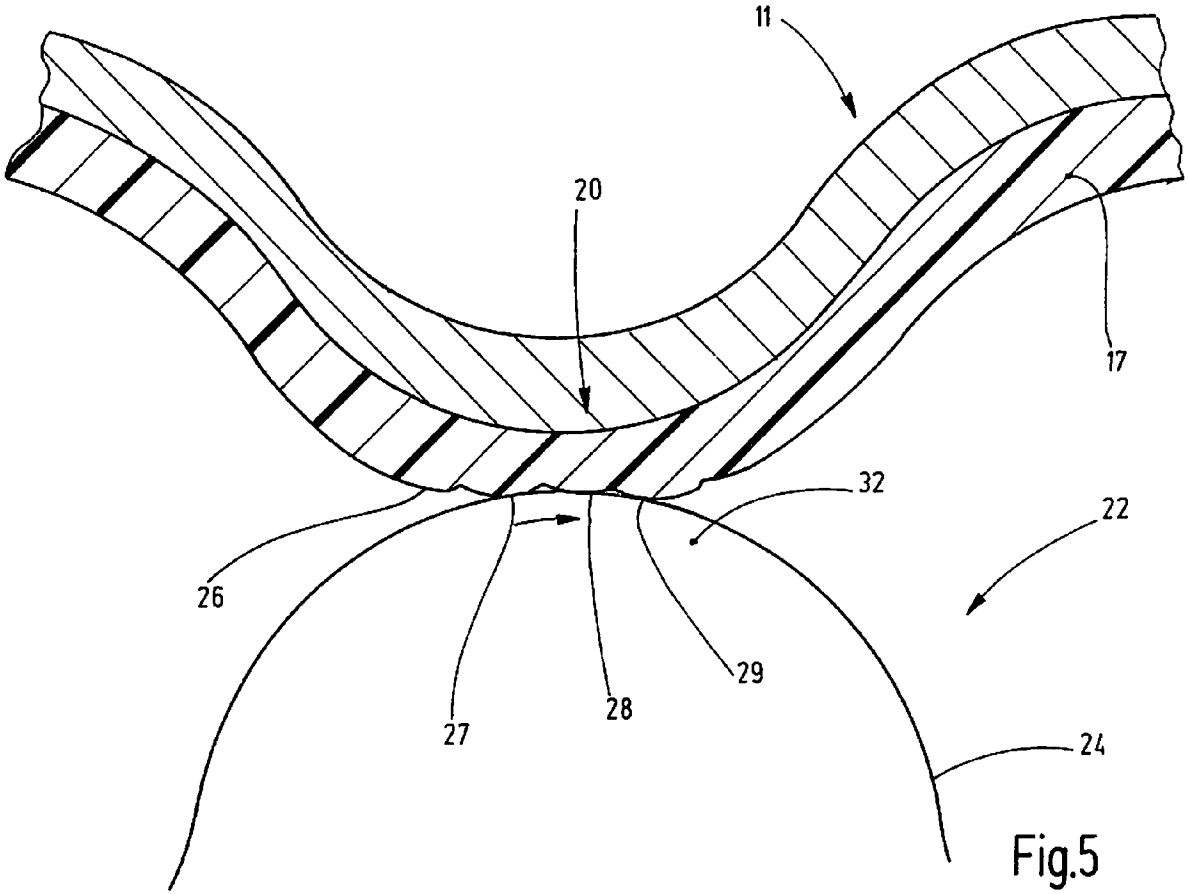
Figure 6:
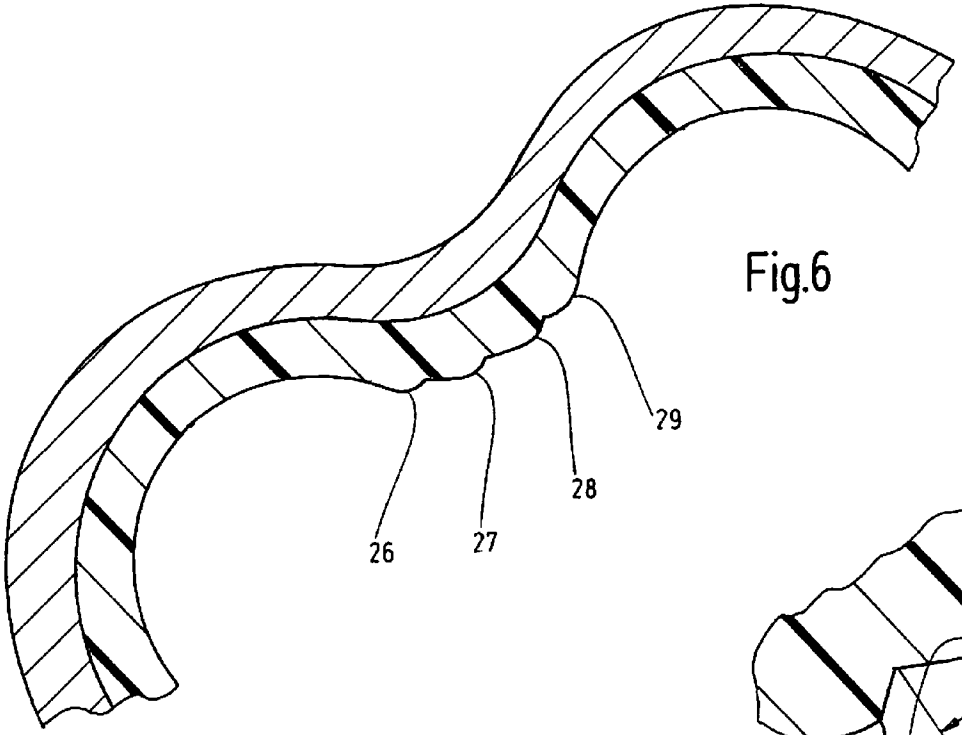
Figure 7:
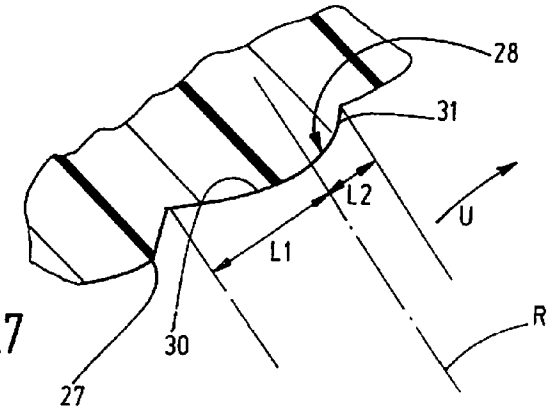
Figure 8:
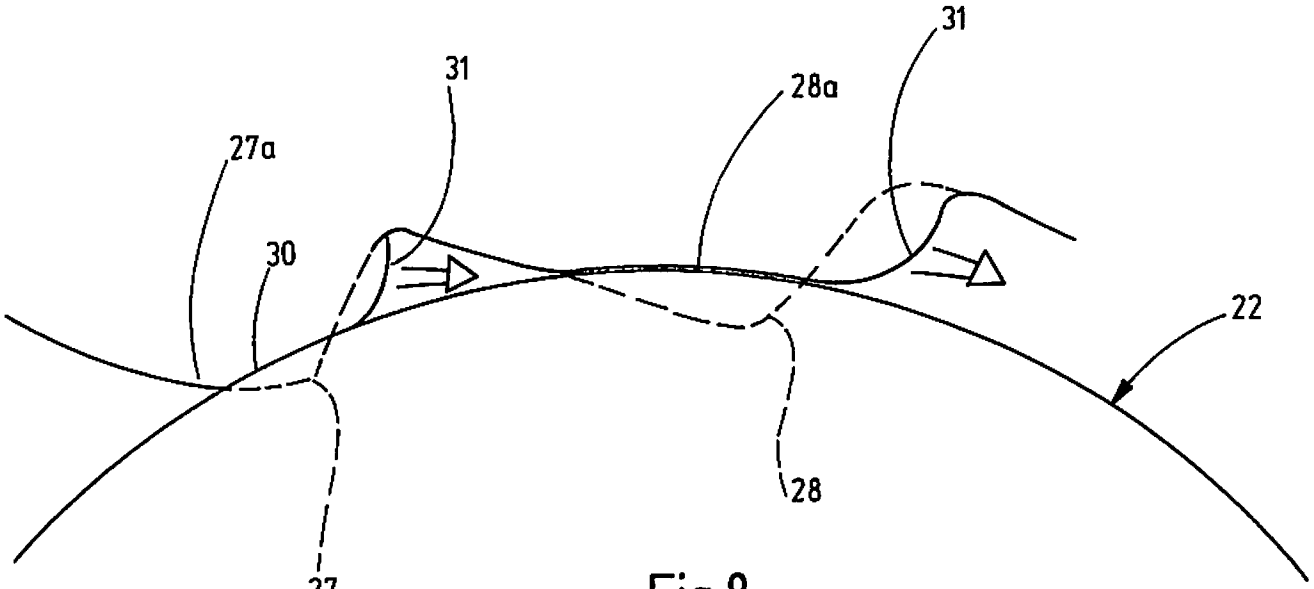

FIG. 5 the eccentric screw machine according to FIG. 3, in a detailed representation using cutouts, FIGS. 6 and 7 the stator of the eccentric screw machine, in a representation using cutouts, and FIG. 8 the rotor and the stator with deformed micro-ribs in schematic representation.

DETAILED DESCRIPTION OF THE INVENTION

FIG. 1 illustrates an eccentric screw machine 10, which can be used as a pump or also as a motor. Belonging to it is a stator 11, which is arranged concentric to a centerline 12 and the face of which is connected to feed and discharge flanges 13, 14. The other functional design emerges from FIG. 2. According to this Figure, the stator 11 defines a channel 15 longitudinally passing through the stator 11. The Stator 11 comprises a tube 16, which is corrugated longitudinally and circumferentially and is provided with an elastomeric lining 17. The latter preferably demonstrates an essentially uniform thickness.

The cross section of the tube 16 and lining 17 emerges from FIG. 3. As evident, the cross section illustrated there demonstrates a plurality of locations 18, 19 that demonstrate a maximum radius $R_1$. Between these locations 18, 19, the stator 11 demonstrates inward protuberances 20, 21, which can be considered as teeth of a helical-cut, hollow gearwheel. In the embodiment example according to FIG. 3, the stator 11 demonstrates five inwardly projecting teeth. In the embodiment example according to FIG. 4, a corresponding stator 11' demonstrates only two teeth, which are formed by the locations 20, 21. In addition, the lining 17 demonstrates a varying thickness there, so that the tube 16 can be embodied hollow-cylindrical. The latter measure can also be used in the embodiment example according to FIG. 3.

The locations 20, 21 define teeth, which wind screw-shaped around the centerline 12 of stator 11 and extend along the stator's entire length. The locations 18, 19 situated therebetween are formed by corresponding helical grooves, which are thus tooth spaces.

A rotor 22, whose cross section forms a helical gear pinion whose tooth number is one less than the tooth number of the cross section of stator 11, is arranged in channel 15. The stator 22 demonstrates teeth 24, 25, which wind around the rotor axis 23 and engage the spacewidths of the stator 11. The maximum diameter of the rotor 22 measured between the tooth tips of same is dimensioned so that the rotor 22 sealingly partitions off separate chambers from the channel 15, the tooth tips each closely and sealingly fitting the lining 17. This is evident in FIG. 5 in the example of the tip of the tooth 24 of rotor 22 and the inwardly directed protuberance 20 of stator 11.

In the vicinity of the part of location 20 that protrudes the farthest, i.e. in the vicinity of the tooth tip of the external tooth, the lining 17, which preferably is otherwise essentially uniformly thick, demonstrates at least one, preferably a plurality of micro-ribs 26, 27, 28, 29 even or odd in number. The micro-ribs 26, 27, 28, 29, extend parallel to the inwardly projecting rib, which is formed by location 20. All other inwardly projecting ribs or teeth of the stator 11 are provided with exactly the same micro-ribs 26, 27, 28, 29.

Among themselves, the micro-ribs 26, 27, 28, 29 can be embodied identically or also somewhat differently. Common to them, however, is the asymmetry with respect to the radial direction R evident from FIGS. 5 to 7 (see FIG. 7, in which the micro-rib 28 is illustrated separately). The micro-rib 28 has an orientation that arises from its asymmetry. In the example, it is embodied rounded and demonstrates a rising edge 30 and a falling edge 31. Measured in the circumferential direction U, the rising edge 30 demonstrates a length L1, which is larger than that L2 of edge 31 measured in the corresponding direction. The transition between the edges 30, 31 can be embodied round or also as a sharp bend. The transition between adjacent micro-ribs can likewise be embodied round or as a sharp bend.

The insofar described eccentric screw machine 10 operates as follows:

Refer to FIG. 3. With the stator 11, the rotor 22 delimits a plurality of banana-shaped chambers, wherein it rotates around its rotor axis 23, clockwise for example, if it is driven by the medium or rotates to convey a medium. To this end, its cross section additionally executes an orbital movement around the centerline 12. Using its tooth 24 and FIG. 5 as an example, it is evident that the tip of each tooth brushes over the inwardly directed locations, location 20 in this case, to go from one tooth space to the adjacent tooth space. The tooth tip 32 of tooth 24 deforms the micro-ribs 26, 27, 28, 29 in succession. To this end, it slides along these micro-ribs 26 to 29, and indeed preferably so that it first passes the longer rising edge 30 and then the shorter falling edge 31. The lubrication of the rotor 22 on the tooth tips is improved in this manner, especially when the motor is in operation. Finally, the micro-ribs 26 to 29 not only have an asymmetrical shape, but also an asymmetrical spring characteristic. They can relatively easily avoid the tooth tip 32 and nevertheless provide a good sealing effect.

FIG. 8 illustrates the effect of the asymmetry of micro-ribs separately. The shape of the undeformed micro-ribs 27, 28 is illustrated dashed. Due to their asymmetry, the rotor 22 displaces and deforms the micro-ribs 27, 28 into the shape 27*a*, 28*a*. The flatter edges 30 thus fit the rotor 22 closely in a wide stripe. The displaced elastomeric material of the micro-ribs 27, 28 leads to bulging of the steeper edges 31. This displaces fluid confined between the micro-ribs 27, 28 and the rotor 22 in the direction of the drawn arrow and presses it between the next flat edge 30 and the rotor contour as fluid film. On the one hand, this supports a wide, sealing, streaky contact between the rotor and the stator, which is beneficial for the sealing effect, and on the other hand, this reduces friction and wear.

Similar advantages emerge in the single-tooth rotor 22' according to the figure or in stator-rotor arrangements of another tooth number.

The eccentric screw machine 10 according to the invention demonstrates a stator 11 having an inner lining 17, which demonstrates teeth projecting inwards. The tips of these teeth are provided with micro-ribs 26 to 29, which are embodied asymmetrically with respect to the radials R. They preferably demonstrate a flatly rising edge 30 and a steeply falling edge 31. This thus results in improved operating performance, depending on the direction of rotation.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

LIST OF REFERENCE CHARACTERS

10 Eccentric screw machine
11, 11' Stator
12 Centerline
13, 14 Feed and discharge flanges
15 Channel through the stator 11
16 Tube

17 Lining of tube 16
18, 19 Locations of the stator 11 with maximum radius $R_1$
$R_1$ Maximum inner radius of the stator
20, 21 Inward protuberances of the stator 11
22, 22' Rotor
23 Rotor axis
24, 25 Teeth
26-29 Micro-ribs
R Radial direction
U Circumferential direction
30 Rising edge
31 Falling edge
L1 Length of the edge 30
L2 Length of the edge 31
32 Tooth tip

I claim:

1. Eccentric screw machine (10), especially for sludgy media, comprising a stator (11), which demonstrates a channel (15) delimited by an elastomeric material, wherein the channel (15) has a cross section which demonstrates a maximum radius ($R_1$) at at least two locations (18, 19) separated from one another in the circumferential direction (U) and demonstrates inward protuberances (20, 21) between them, wherein other projections (26-29) are arranged on the inward protuberances (20, 21), further comprising a rotor (22), which is arranged in the channel (15) of the stator (11) to delimit at least one chamber, characterized in that the other projections (26-29) are embodied asymmetrically relative to the radial direction (R), wherein the other projections (26, 27, 28, 29) relative to one direction of rotation of the rotor (22) are asymmetric in the same direction; and wherein the other projections (26, 27, 28, 29) demonstrate a leading edge (30) with respect to the rotation of the rotor (22) and that said leading edge is more flatly inclined than its trailing edge (31).

2. The eccentric screw machine according to claim 1, characterized in that the at least two locations (18, 19) which are separated from one another in the circumferential direction (U) and define the maximum radius ($R_1$) are formed by helical grooves, which extend along the stator (11) and wind around its centerline (12).

3. The eccentric screw machine according to claim 1, characterized in that the other projections (26-29) extend along the protuberances (20, 21).

4. The eccentric screw machine according to claim 1, characterized in that the other projections (26, 27, 28, 29) are micro-ribs.

5. The eccentric screw machine according to claim 1, characterized in that the other projections (26, 27, 28, 29) demonstrate a length (L1+L2) which, as measured in the circumferential direction (U), is substantially smaller than the length of the inward protuberance (20, 21) measured in the same circumferential direction.

6. The eccentric screw machine according to claim 1, characterized in that the other projections (26, 27, 28, 29) demonstrate a height which, as measured in the radial direction (R), is substantially smaller than the height of the inward protuberance (20, 21) likewise measured in the radial direction (R).

7. The eccentric screw machine according to claim 1, characterized in that the stator (11) demonstrates at least one of the other projections (26, 27, 28, 29) on each inward protuberance (20, 21).

8. The eccentric screw machine according to claim 7, characterized in that the stator (11) demonstrates a plurality of other projections (26, 27, 28, 29) on each inward protuberance (20, 21).

9. The eccentric screw machine according to claim 1, characterized in that the leading edge (30) as measured in the circumferential direction (U) is longer than the trailing edge (31).

10. The eccentric screw machine according to claim 1, characterized in that a border having a corrugated course delimits a cross section of the stator (11) in such a manner that the inward protuberances (20, 21) in the channel (15) form teeth that run a screw-shaped course similarly to a helical-cut hollow wheel.

11. The eccentric screw machine according to claim 10, characterized in that the rotor (22) has the shape of a single-tooth or multi-tooth, helical-geared pinion and is adapted to the shape of the channel (15) in such a manner that it can roll off the wall of same.

12. The eccentric screw machine according to claim 11, characterized in that the teeth of the rotor (22) sealingly engage liner (17) of the stator (11).

13. The eccentric screw machine according to claim 1, characterized in that each inward protuberance (20, 21) bears an even number of the other projections (26, 27, 28, 29).

14. The eccentric screw machine according to claim 1, characterized in that each inward protuberance (20, 21) bears an odd number of the other projections (26, 27, 28 and 29).

15. Eccentric screw machine (10), especially for sludgy media, comprising a stator (11), which demonstrates a channel (15) delimited by an elastomeric material, wherein the channel (15) has a cross section which demonstrates a maximum radius ($R_1$) at at least two locations (18, 19) separated from one another in the circumferential direction (U) and demonstrates inward protuberances (20, 21) between them, wherein other projections (26-29) are arranged on the inward protuberances (20, 21), further comprising a rotor (22), which is arranged in the channel (15) of the stator (11) to delimit at least one chamber, characterized in that the other projections (26-29) are embodied asymmetrically relative to the radial direction (R), and wherein the other projections (26, 27, 28, 29) have a leading edge (30) with respect to the rotation of the rotor (22) and that said leading edge is more flatly inclined than a trailing edge (31).

16. The eccentric screw machine according to claim 15 characterized in that the leading edge (30) as measured in the circumferential direction (U) is longer than the trailing edge (31).

* * * * *